US005127684A

United States Patent [19]

Klotz et al.

[11] Patent Number: 5,127,684

[45] Date of Patent: Jul. 7, 1992

[54] TENSION CLAMP

[75] Inventors: Arthur Klotz, Remseck; Rudolf Leipelt, Marbach, both of Fed. Rep. of Germany

[73] Assignee: Filterwerk Mann & Hummel GmbH, Ludwigsburg, Fed. Rep. of Germany

[21] Appl. No.: 596,218

[22] Filed: Oct. 12, 1990

[30] Foreign Application Priority Data

Oct. 18, 1989 [DE] Fed. Rep. of Germany ..... 3934663

[51] Int. Cl.[5] ..... E05C 5/02

[52] U.S. Cl. ..... 292/113; 292/DIG. 38; 292/DIG. 53; 292/DIG. 61

[58] Field of Search ..... 292/113, 247, DIG. 38, 292/DIG. 53, DIG. 61

[56] References Cited

U.S. PATENT DOCUMENTS

| | | | |
|---|---|---|---|
| 2,626,010 | 1/1953 | Sebok | 183/15 |
| 2,808,959 | 10/1957 | Harris | 292/113 X |
| 3,490,805 | 1/1970 | Di Pierro et al. | 292/258 |
| 3,524,212 | 8/1970 | Spencer | 292/113 X |
| 3,526,423 | 9/1970 | Newcomer et al. | 292/113 |
| 3,847,423 | 11/1971 | Gley | 292/113 |
| 4,023,840 | 5/1977 | Souza et al. | 292/DIG. 38 X |
| 4,270,668 | 6/1981 | Berfield | 292/DIG. 38 X |
| 4,678,216 | 7/1987 | Gregory | 292/DIG. 38 X |

FOREIGN PATENT DOCUMENTS

| | | |
|---|---|---|
| 1668776 | 12/1951 | Fed. Rep. of Germany . |
| 1963200 | 6/1967 | Fed. Rep. of Germany . |
| 3429635 | 2/1986 | Fed. Rep. of Germany . |
| 3536157 | 4/1987 | Fed. Rep. of Germany . |
| 1280722 | 11/1961 | France . |

*Primary Examiner*—Richard E. Moore
*Attorney, Agent, or Firm*—Foley & Lardner

[57] ABSTRACT

A tension clamp for releasably joining two components. The clamp is anchored on a first component 10 by a mounting element 18 and is hooked onto the second component 11. The mounting element 18 is inserted under resilient bias into securing elements 17 on the first component, and has a resilient portion which produces the tension forces for joining the two components 10 and 11. The locking hook 20, which hooks onto the second component 11, is connected to the mounting element 18 by an intermediate link 19 and is preferably a plastic injection molding.

9 Claims, 2 Drawing Sheets

TENSION CLAMP

BACKGROUND OF THE INVENTION

This invention relates to a tension clamp for releasably joining first and second components, in which the clamp is anchored to the first component by a resiliently biased mounting element arranged in a recess in the first component and is hooked onto the second component.

Tension clamps are known having different configurations. Such tension clamps serve to releasably clamp two components together, for example to fasten an air filter cover to an air filter housing, so that maintenance of the air filter can be performed readily.

Published German Patent Application No. DE 35 36 157 describes a tension clamp which is made of wire material. The production of the individual wire elements involves considerable difficulty. Special apparatus are required for assembling the individual parts.

Another tension clamp is disclosed in U.S. Pat. No. 3,490,805 in which the clamp is not a device made of wire, but a one-piece device made of flat material. It must, however, be capable of yielding resiliently to the tension forces. Furthermore, a film hinge is provided between the locking hook and the mounting element. Since this film hinge must transmit the forces to the mounting element, there is a danger that this film hinge will be destroyed within a short time.

SUMMARY OF THE INVENTION

It is therefore the object of the invention to provide a tension clamp which will be easy to manufacture and can be assembled without great difficulty.

Another object of the invention is to provide a tension clamp which is durable and will operate reliably for a long period of time.

These and other objects of the invention are achieved in accordance with the invention by providing a tension clamp for releasably joining first and second components, wherein the clamp is anchored to the first component by a resiliently biased mounting element arranged in a recess in the first component and is hooked onto the second component, the clamp comprises a locking hook which engages the second component, the locking hook is connected to the mounting element by an intermediate link, and the mounting element comprises a resilient portion which produces the clamping forces for joining the first and second components.

One important advantage of the invention is that the mounting element is in the form of a spring such that it can yield to the tension forces involved in the clamping of the individual components. Thus, the sealing abutment can be made rigid and consequently becomes considerably simpler.

Heretofore it has been necessary to make this locking hook resilient in order to absorb the tension forces. As a result, however, special designs were necessary in order to achieve a certain spring function in an element created for the purpose of clamping.

The advantage of the invention over this known state of the art consists in the fact that in this case a sturdy clamp is created which has a very long life.

According to a further development of the invention it is proposed to manufacture the locking hook as an injection molded plastic part. Such a part is very inexpensive to manufacture and can present a good appearance. To simplify assembly it is proposed, in a further development of the invention, to provide a snap connection for attaching the intermediate link to the locking hook.

Further aspects of the invention are set forth in the following description and claims.

BRIEF DESCRIPTION OF THE DRAWINGS

The invention will be explained in further detail below with reference to non-limiting preferred embodiments illustrated in the accompanying drawings, wherein.

DETAILED DESCRIPTION OF PREFERRED EMBODIMENTS

Figure 1:
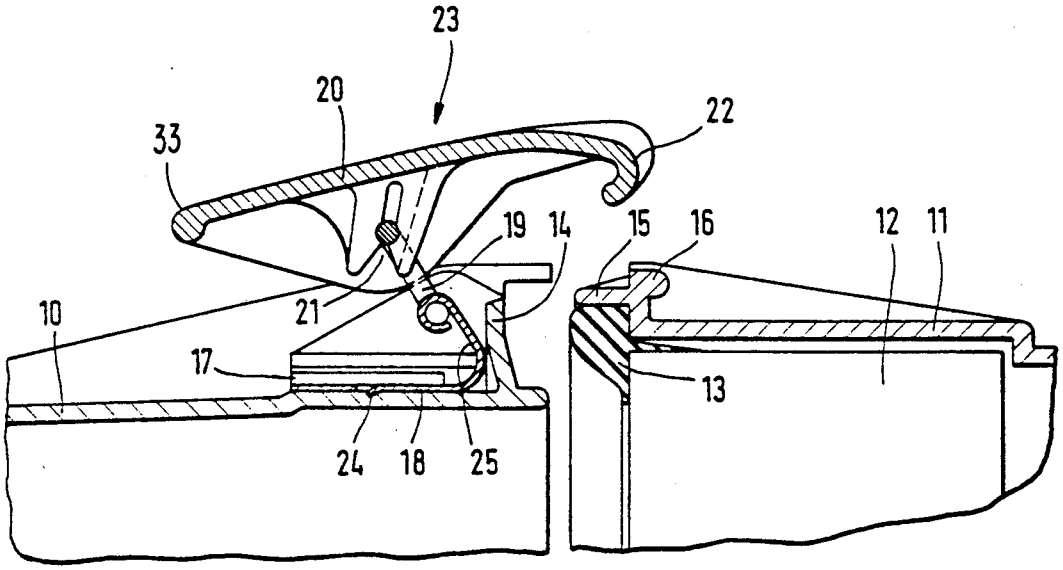
FIG. 1 shows a tension clamp in the open position.

FIG. 1 shows part of a clean air housing 10 of an air filter enclosure to which a filter cover 11 is to be fastened, which also is shown only in part. In this filter cover is an air filter 12. Between the filter cover 11 and the clean air housing 10 there is a gasket 13 for forming an air-tight joint between the two parts.

A tension clamp 23 for releasably joining the filter cover and the clean air housing is arranged on a mounting element 18 secured to the housing by securing elements 17. The securing elements 17 are so configured that the mounting element 18 can be inserted in the direction of the filter cover 11. A spur 24 on the mounting element provides for a secure retention of the mounting element on the clean air housing 10.

The mounting element 18 is made of spring steel and is provided with an eye on its free end to accommodate a intermediate link 19. The intermediate link 19 is a wire loop onto which a locking hook 20 is snapped by means of a snap-in slot 21. The locking hook 20 is injection molded from plastic material. It is hooked at its end 22 and can engage a bead 16 on the filter cover 11. End 33 of locking hook 20 may be referred to as the grip end.

Figure 2:
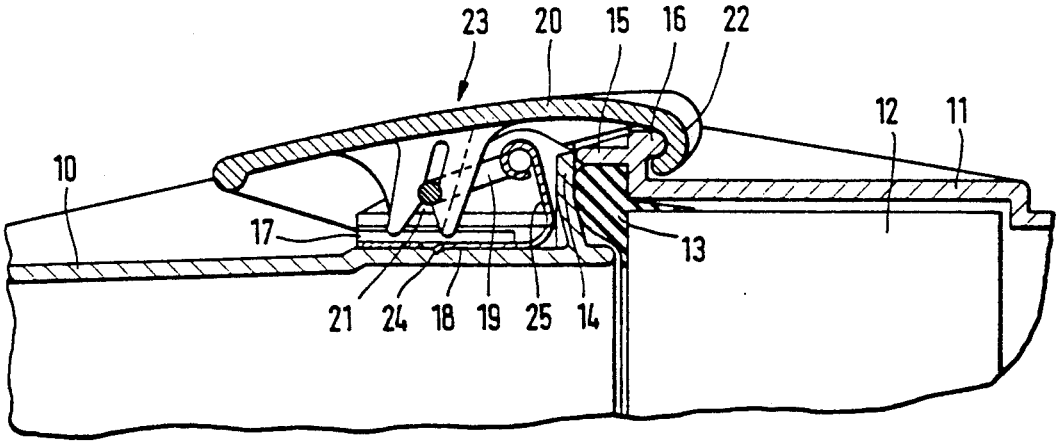
FIG. 2 shows the tension clamp of FIG. 1 in the closed position.

FIG. 2 shows the tension clamp in the closed position. The hooked end 22 of the locking hook 20 lies against the filter cover 11 and urges the filter cover 11 against the clean air housing 10. The clean air housing 10 is provided with a sealing abutment 14 which in conjunction with the sealing edge 15 serves to form a tight abutment between the clean air housing and the filter cover, so that the gasket 13 does not have to withstand excessive clamping forces that might cause excessive deformation.

As it can be seen from a comparison of the two FIGS. 1 and 2, the spring force of the tension clamp is applied solely by the upstanding resilient arm 25 of the mounting element 18.

Due to the snap connection between the locking hook 20 and the intermediate link 19, the assembly of the parts and even the replacement of the locking hook 20 can be performed easily.

Figure 3:
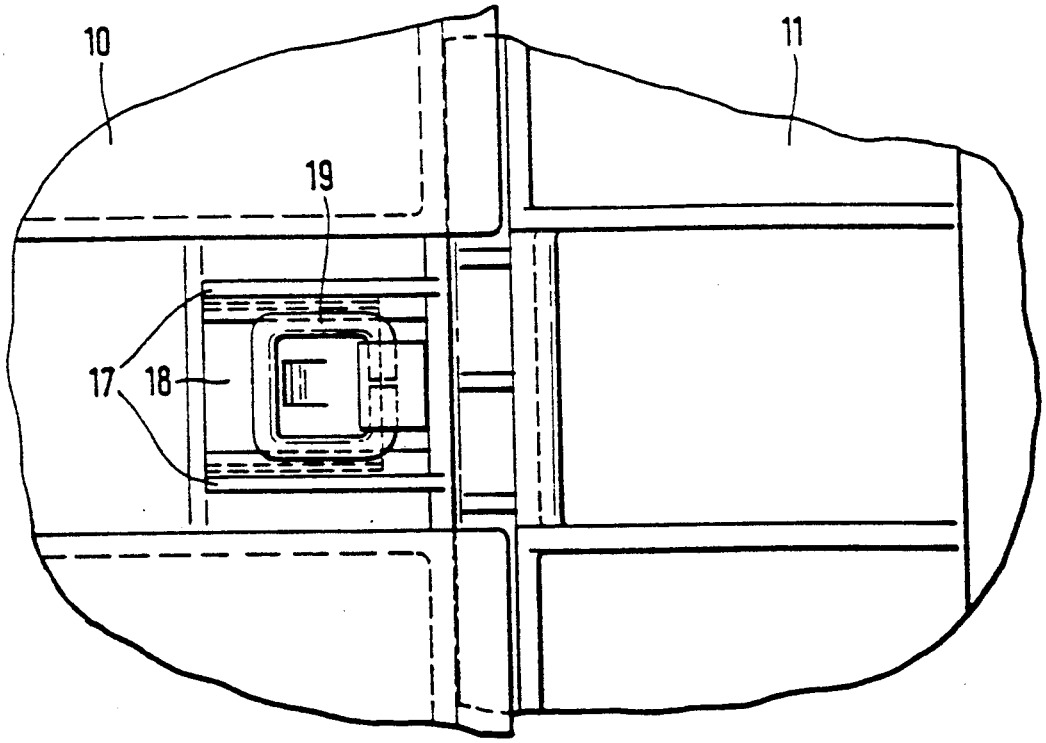
FIG. 3 is a top view of the mounting element of the tension clamp.

The top view in FIG. 3 shows the configuration of the mounting element 18 which is situated between the securing elements 17. The intermediate link 19 is shown on the mounting element 18. The locking hook has been omitted for greater ease of illustration.

Figure 4:
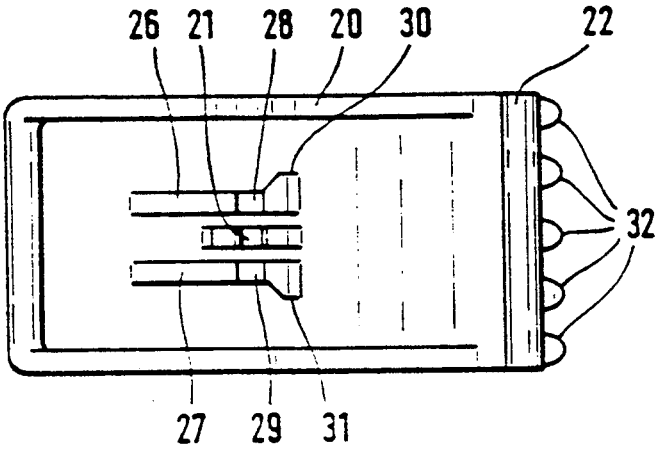
FIG. 4 is a bottom view of the locking hook.

The locking hook 20 shown in FIG. 4, which here appears in a bottom view, has on its underside a central lug which contains the snap-in slot 21. Two outer lugs 26 and 27 are also provided with slots 28 and 29 to hold the intermediate link 19 (not shown here) in place. The portions 26 and 27 furthermore contain guide lugs 30 and 31 which prevent lateral displacement of the locking hook 20 on the intermediate link 19. Reinforcing ribs 32, which can be provided in greater or lesser number depending on the applied stress, are disposed on the end 22 of the locking hook 20.

The foregoing description and examples have been set forth merely to illustrate the invention and are not intended to be limiting. Since modifications of the described embodiments incorporating the spirit and substance of the invention may occur to persons skilled in the art, the scope of the invention should be construed to include all modifications falling within the ambit of the appended claims and equivalents thereof.

What is claimed is:

1. A tension clamp arrangement comprising:

first and second components to be releasably joined;

a locking hook formed as a single integral piece having a grip end, a hook end for hookingly engaging one of said components to be joined, and attaching means intermediate said grip end and said hook end;

a mounting element anchored to the other of said components to be joined and having a resilient, projecting arm; and an intermediate link pivotally mounted on said resilient arm of said mounting element and pivotally attached to said attaching means of said locking hook such that when said hook end hookingly engages said one component and said locking hook is pushed toward said other component, said first and second components are clamped together by a spring force applied solely by said resilient arm of said mounting element.

2. A tension clamp arrangement according to claim 1, wherein said locking hook is a plastic injection molding.

3. A tension clamp arrangement according to claim 1, wherein said locking hook is attached to said intermediate link by a snap fastener.

4. A clamp arrangement according to claim 1, further comprising a seal member interposed between said first and second components.

5. A clamp arrangement according to claim 1, wherein said intermediate link is a wire loop.

6. A clamp arrangement according to claim 1, further comprising a plurality of reinforcing ribs on said hook end of said locking hook.

7. A clamp arrangement according to claim 1, wherein said mounting element is disposed in a recess in said other component.

8. A clamp arrangement according to claim 1, wherein said resilient arm has a free end formed with an eyelet in which said intermediate link is pivotally received.

9. A clamp arrangement according to claim 1, wherein said mounting element is formed of spring steel.

* * * * *